US007617655B2

(12) United States Patent
Gill et al.

(10) Patent No.: US 7,617,655 B2
(45) Date of Patent: Nov. 17, 2009

(54) BULK BAG TIE-OFF ASSEMBLY

(75) Inventors: David R. Gill, Easton, PA (US); Keith W. Sterner, Bethlehem, PA (US); David A. Dunker, Slatedale, PA (US); John F. Simonof, Jr., Easton, PA (US)

(73) Assignee: Flexicon Corporation, Bethlehem, PA (US)

( * ) Notice: Subject to any disclaimer, the term of this patent is extended or adjusted under 35 U.S.C. 154(b) by 227 days.

(21) Appl. No.: 11/428,709

(22) Filed: Jul. 5, 2006

(65) Prior Publication Data

US 2007/0017185 A1 Jan. 25, 2007

Related U.S. Application Data

(60) Provisional application No. 60/696,925, filed on Jul. 6, 2005.

(51) Int. Cl.
*B65B 51/04* (2006.01)
*B65B 51/00* (2006.01)

(52) U.S. Cl. ..... 53/417; 53/138.3; 53/284.7

(58) Field of Classification Search ..... 53/138.2, 53/138.3, 139.1, 266.1, 284.7, 417, 473, 53/476; 83/759, 775, 213, 212.1, 600, 610, 83/612

See application file for complete search history.

(56) References Cited

U.S. PATENT DOCUMENTS 2,267,532 A 12/1941 Moberg
2,488,432 A * 11/1949 Paynter ..... 83/775
4,062,383 A 12/1977 Saito
4,621,479 A 11/1986 Hoyland
4,934,416 A 6/1990 Tonkiss
5,163,482 A 11/1992 Wolcott
5,174,094 A 12/1992 Powell, Jr.
5,212,928 A 5/1993 Scott et al.
5,444,962 A 8/1995 Bonnet
5,544,466 A 8/1996 Bonnet
5,628,348 A 5/1997 Scott et al.
5,647,407 A 7/1997 Scott et al.
5,771,664 A 6/1998 Recchia, Jr.
5,909,751 A 6/1999 Teagno
5,957,165 A 9/1999 Watanabe et al.
6,112,499 A 9/2000 Lyskawa et al.
6,176,278 B1 1/2001 Gill et al.
2003/0005664 A1* 1/2003 Topfer ..... 53/138.2

* cited by examiner

*Primary Examiner*—Rinaldi I. Rada
*Assistant Examiner*—John Paradiso
(74) *Attorney, Agent, or Firm*—Volpe and Koenig, P.C.

(57) ABSTRACT

A tie-off assembly for closing the neck of a bulk bag is provided and includes a motor located in a housing which drives a toothed drive wheel. A slot in the housing receives an end of a tie wrap which, upon insertion, is engaged by the toothed drive wheel to pull the tie wrap closed. At least one blade is mounted adjacent the slot, which is moveable from a first position, away from the slot, to a second, cutting position, adjacent the slot. In use, an end of a tie wrap located around the neck is inserted into the slot so that the tie wrap end is engaged by the toothed drive wheel, and operating the motor tightens the tie wrap about the neck of the bulk bag.

14 Claims, 20 Drawing Sheets

BULK BAG TIE-OFF ASSEMBLY

CROSS-REFERENCE TO RELATED APPLICATIONS

This application claims the benefit of U.S. Provisional application 60/696,925, filed Jul. 6, 2005, which is incorporated herein by reference as if fully set forth.

FIELD OF THE INVENTION

The present invention relates to filling equipment for loading powdered or granular material into bulk bags. More particularly, the present invention relates to a bulk bag tie-off assembly and a bulk bag filler with such a device to assist in sealing the top of a bulk bag after filling.

BACKGROUND

Known bulk bag (flexible intermediate bulk containers or FIBCs) fillers generally require an operator to connect the bag filling spout to a generally downwardly directed fill tube and to hook a hanging loop located on each corner of the bulk bag onto an arm or holder on the support structure. Once filled, the bag loops are released as is the seal that holds the bag filling spout to the fill tube. An operator must then reach the top of the filled bag and tie off the neck of the bag filling spout. This is a manual operation that requires an operator to either climb to the required height, for example using a ladder, or reach over the upper edge of the filled bag, potentially causing spillage of the filled material. This not only takes additional time, but also poses the risk of possible operator injury It would be desirable to provide a bulk bag filler that is safer, easier and faster to operate, with less likelihood of operator injury.

SUMMARY

Briefly stated, the present invention provides a tie-off assembly for closing the neck of a bulk bag having a motor located in a housing, with the housing having a cutting end with a slot therethrough. A drive axle within the housing is adapted to be rotated by operation of the motor and rotates a toothed drive wheel mounted on the drive axle. The slot is adapted to receive an end of a tie wrap which, upon insertion, is engaged by the toothed drive wheel to pull the tie wrap closed. At least one blade is mounted adjacent the cutting end of the housing, with the at least one blade being moveable from a first position, away from the slot, to a second, cutting position, adjacent the slot. The blade is biased to the first position by a spring. At least one first wall is mounted for movement adjacent the cutting end of the housing and is adapted to move from a first, rest position to a second, engaged position adjacent the cutting end. The first wall is adapted to contact and move the blade to the cutting position as the first wall becomes more proximate the cutting end through contact with a knuckle of the tie wrap that is being closed.

In use, a tie wrap positioned around the neck of a bulk bag has its end inserted into the slot of the tie-off assembly as the bulk bag is connected to the bulk bag filler. After the bulk bag is filled, the tie-off assembly is actuated to pull the tie wrap closed, thereby closing and sealing the bulk bag neck. Preferably, the tie-off assembly is mounted for movement on the bulk bag filler frame, so that it can be moved closer to a center of a bulk bag filling spout neck being closed as the tie wrap is tightened. The tail of the tie wrap is automatically cut off by the blade once the tie wrap is fully closed.

Thus, the invention also provides an automated method of tying off the neck of a filled bulk bag. The tie-off assembly can be provided as a part of a bulk bag filler or can be retrofitted to an existing bulk bag filler.

BRIEF DESCRIPTION OF THE DRAWING(S)

The foregoing summary as well as the following detailed description will be readily understood in conjunction with the appended drawings which illustrate the preferred embodiments of the invention. In the drawings.

DETAILED DESCRIPTION OF THE PREFERRED EMBODIMENTS

Figure 1:
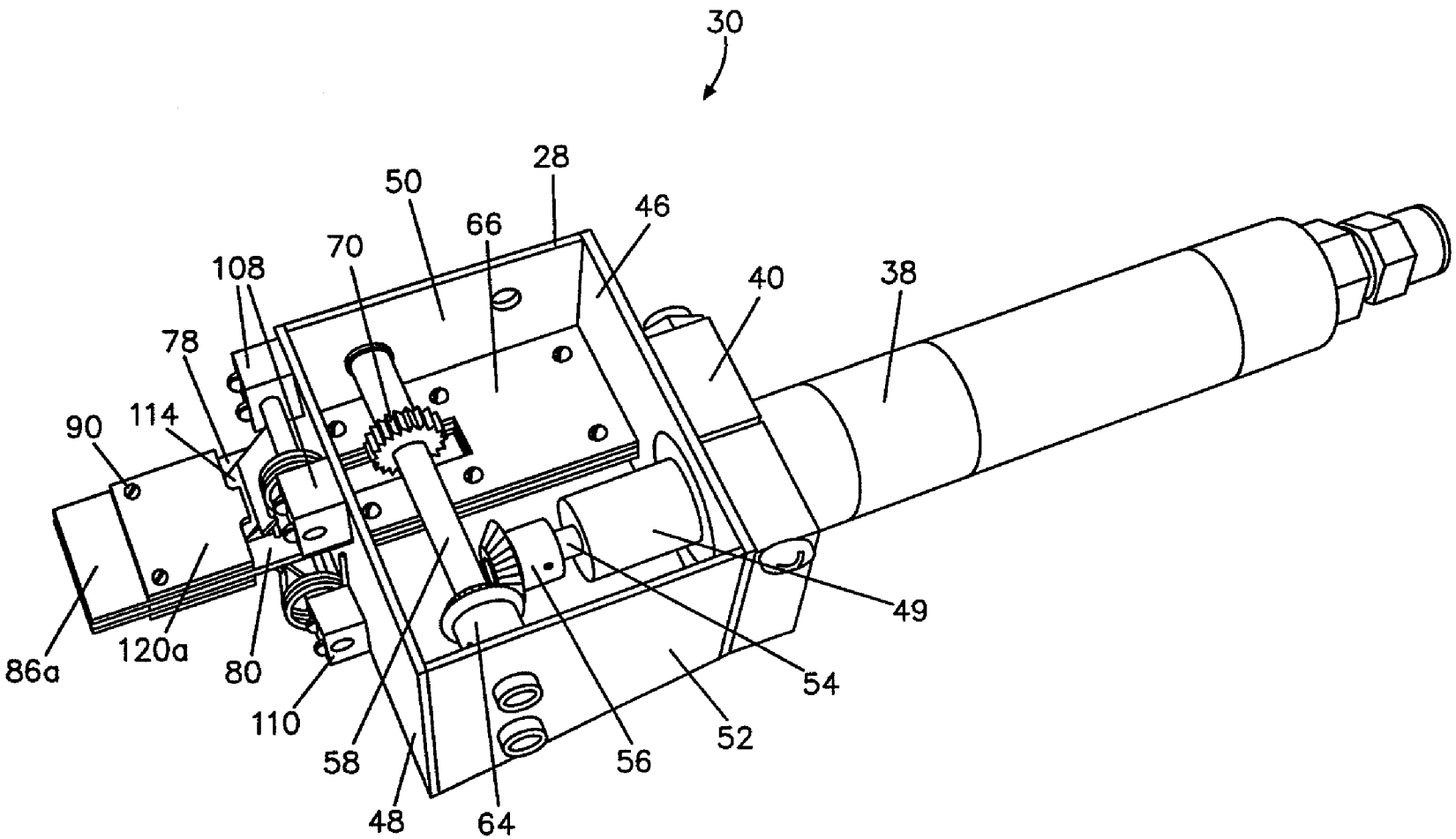
FIG. 1 is a bottom-front perspective view of an embodiment of a tie-off assembly according to the present invention.

Certain terminology is used in the following detailed description for convenience only and is not considered limiting. The words "upper" and "lower" designate directions in the drawings to which reference is made. Additionally, the words "left" and "right" are similarly used to designate directions in the drawings. The terms "a" and "one" are defined as including one or more of the referenced item unless specifically noted.

Figure 20:
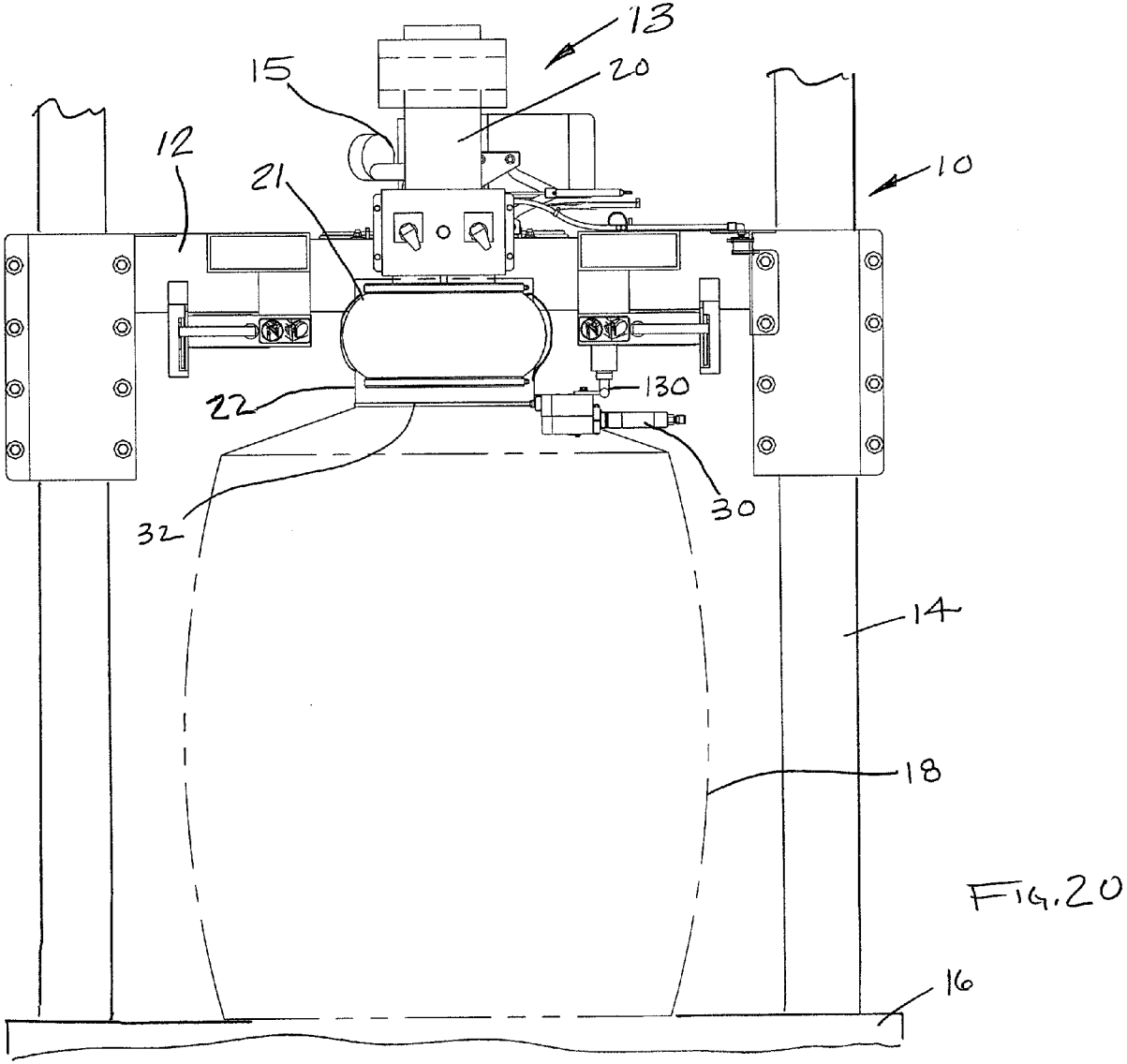
FIG. 20 is a front view of a bulk bag filler and bulk bag with the tie-off assembly according to the invention.
Figure 21:
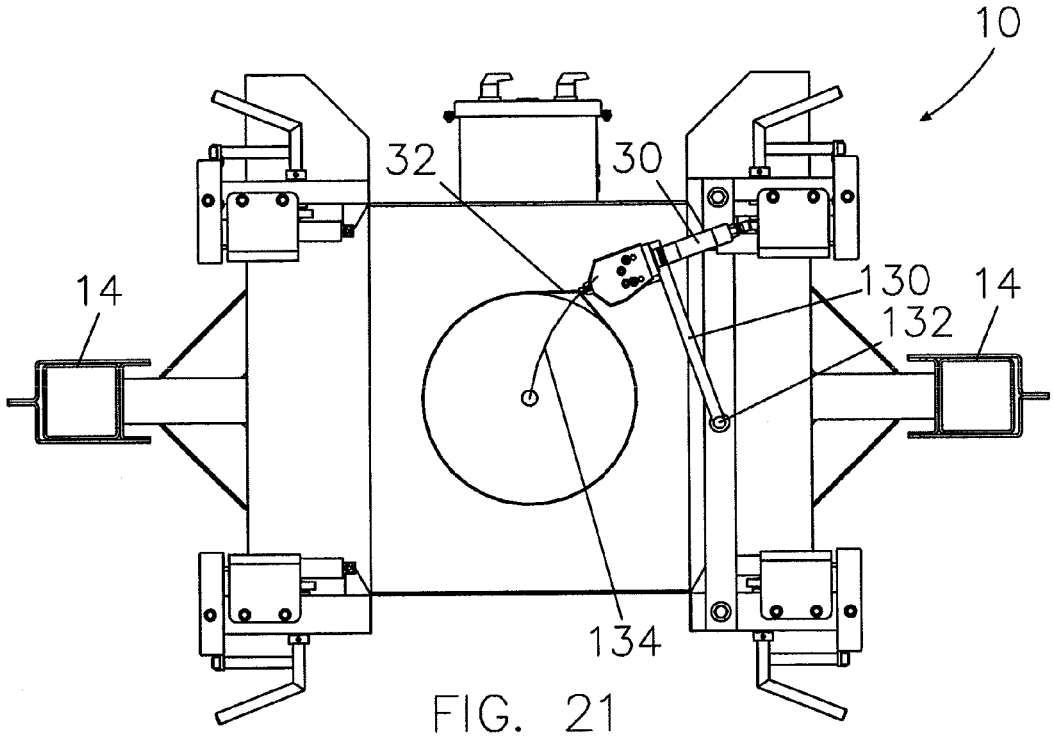
FIG. 21 is a bottom view showing the tie-off assembly mounted on a pivoting support arm on the bulk bag filler.

An exemplary bulk bag filler 10 incorporating the present invention is shown in FIG. 20. The bulk bag filler 10 generally includes a support frame 12 with a bag fill head 13 from which a bulk bag 18 is suspended, having side posts 14, and a base 16. A fill tube 20 is provided, for filling the bulk bag 18. The bulk bag 18 has a bag neck 22 at an upper portion of the bulk bag 18, that surrounds the fill tube 20, when the bulk bag 18 is being loaded with materials via the fill tube 20. The bag neck 22 must be closed once the bulk bag 18 has been filled. An exemplary bulk bag filler is described in detail in co-pending U.S. Pat. No. 7,004,212, the entire contents of which is incorporated by reference herein.

A bag inflation/vacuum port 15 is preferably provided which allows for inflation of an empty bag prior to filling, as well as collection of displaced air and particulates which could otherwise be discharged to atmosphere as the bag is filled. In a preferred embodiment, an inflatable seal assembly 21 is provided where the fill tube 20 meets the bag neck 22, for connecting the bag neck 22 to the bulk material fill tube 20. Such inflatable connections are known in the art, and accordingly have not been described here in further detail.

Figure 8:
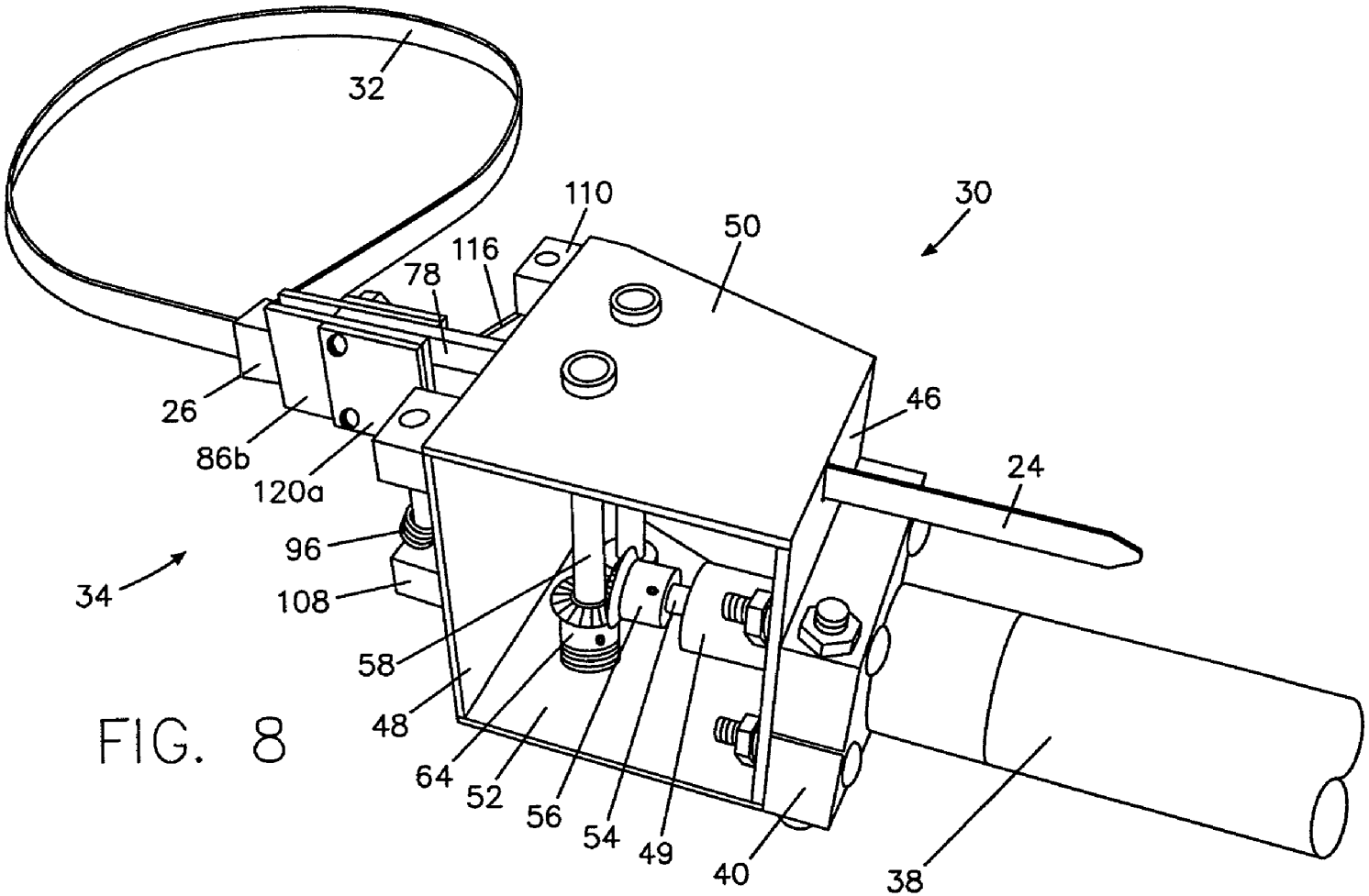
FIG. 8 is a perspective view from a top of the tie-off assembly according to the present invention shown in FIG. 1, with a tie wrap being drawn into the housing of the tie-off assembly.
Figure 9:
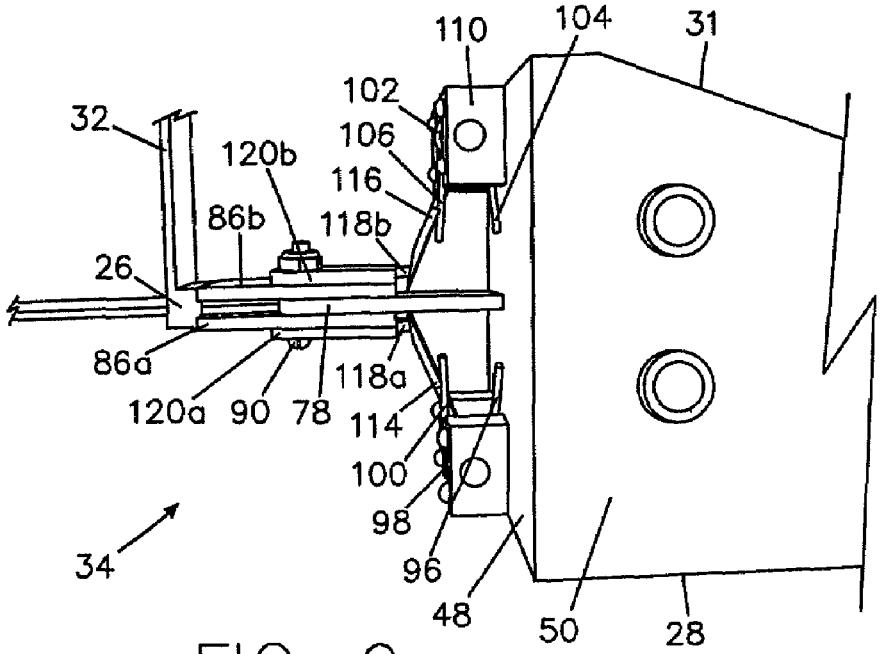
FIG. 9 is a top perspective view of the tie-off assembly according to the present invention shown in FIG. 1, with a tie wrap being drawn into the housing of the tie-off assembly.
Figure 10:
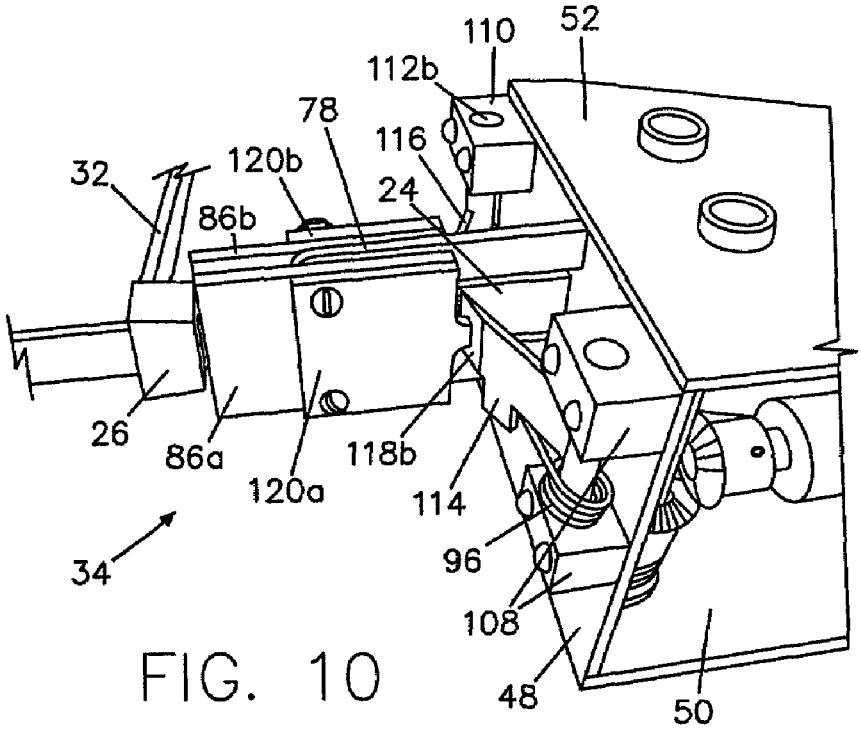
FIG. 10 is a close-up perspective view of the cutting end of the tie-off assembly according to the present invention shown in FIG. 1, with a tie wrap being drawn into the housing of the tie-off assembly.
Figure 11:
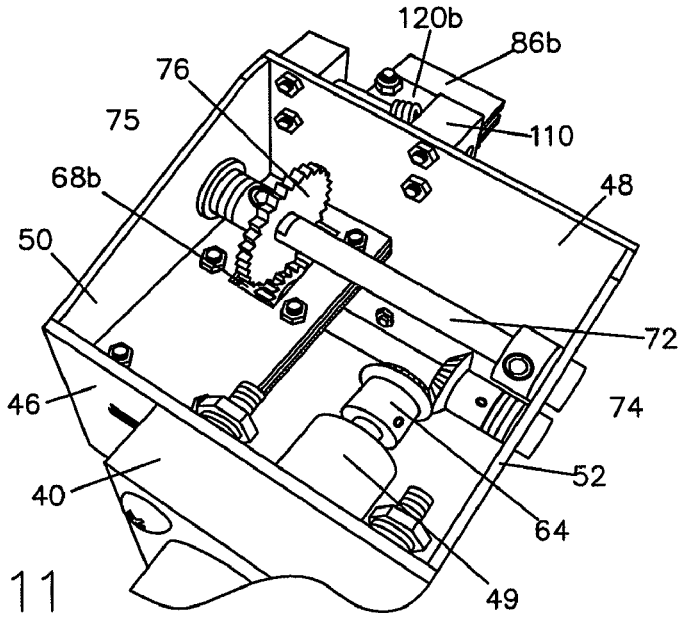
FIG. 11 is a close up left side perspective view of the tie-off assembly according to the present invention shown in FIG. 1, with a tie wrap being drawn into the housing of the tie-off assembly.

According to the present, a bulk bag tie-off assembly 30 is provided adjacent an upper portion of the support frame 12 or fill head 13, preferably adjacent the position where the bag neck 22 will be when the bulk bag 18 is mounted on the support frame 12 for filling. The tie-off device 30 securely closes an open bulk bag 18 by tightening a tie wrap 32 around the bag neck 22. After closure, the tie-off assembly 30 uses a cutting assembly 34 to cut the free end 24 of the tie wrap 32, as shown in FIGS. 8 and 10.

Another common name for "tie wrap" is "cable tie." While the present invention preferably utilizes tie wraps, it is appreciated that other types of securing materials, such as cables, wires, plastic wraps, or other closure articles can be used in place of tie wraps.

Figure 15:
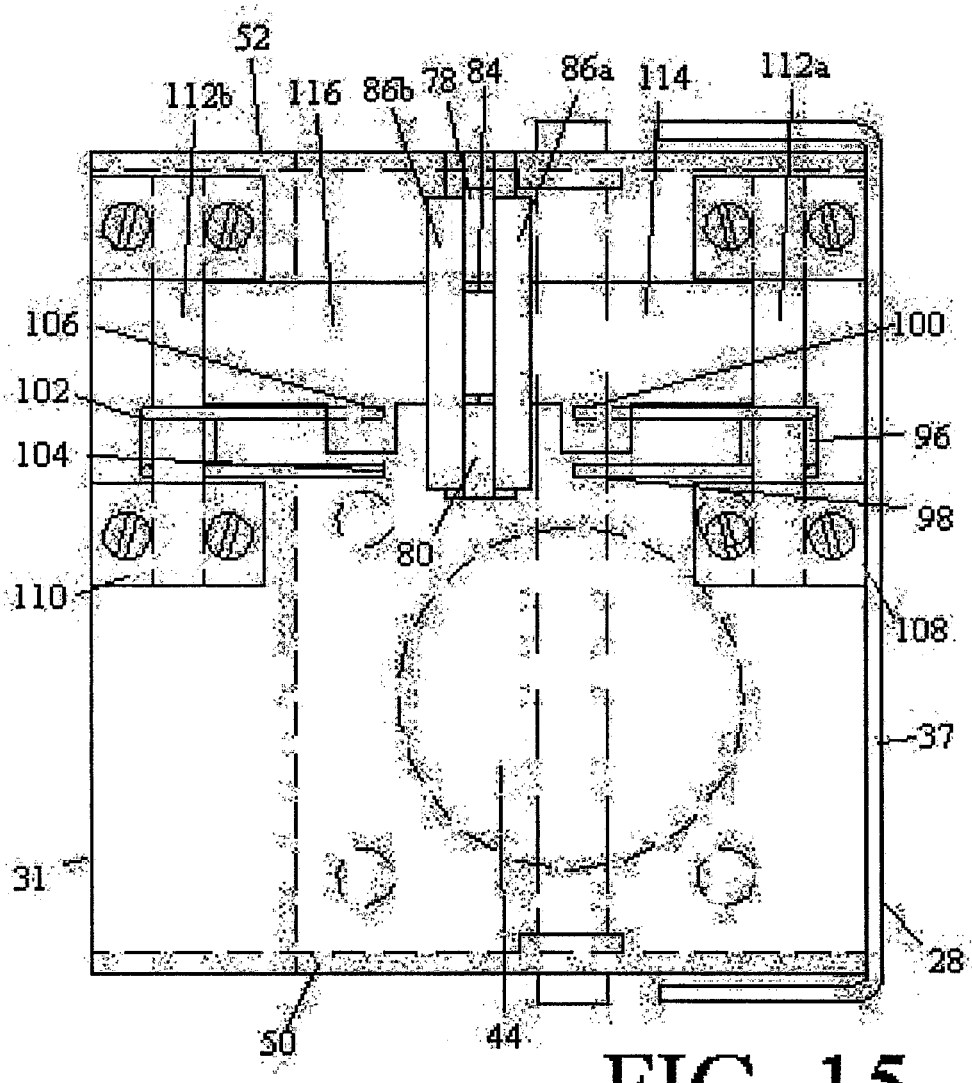
FIG. 15 is a cutting end elevational view with partial transparency of the embodiment of a tie-off assembly according to the present invention shown in FIG. 12.
Figure 16:
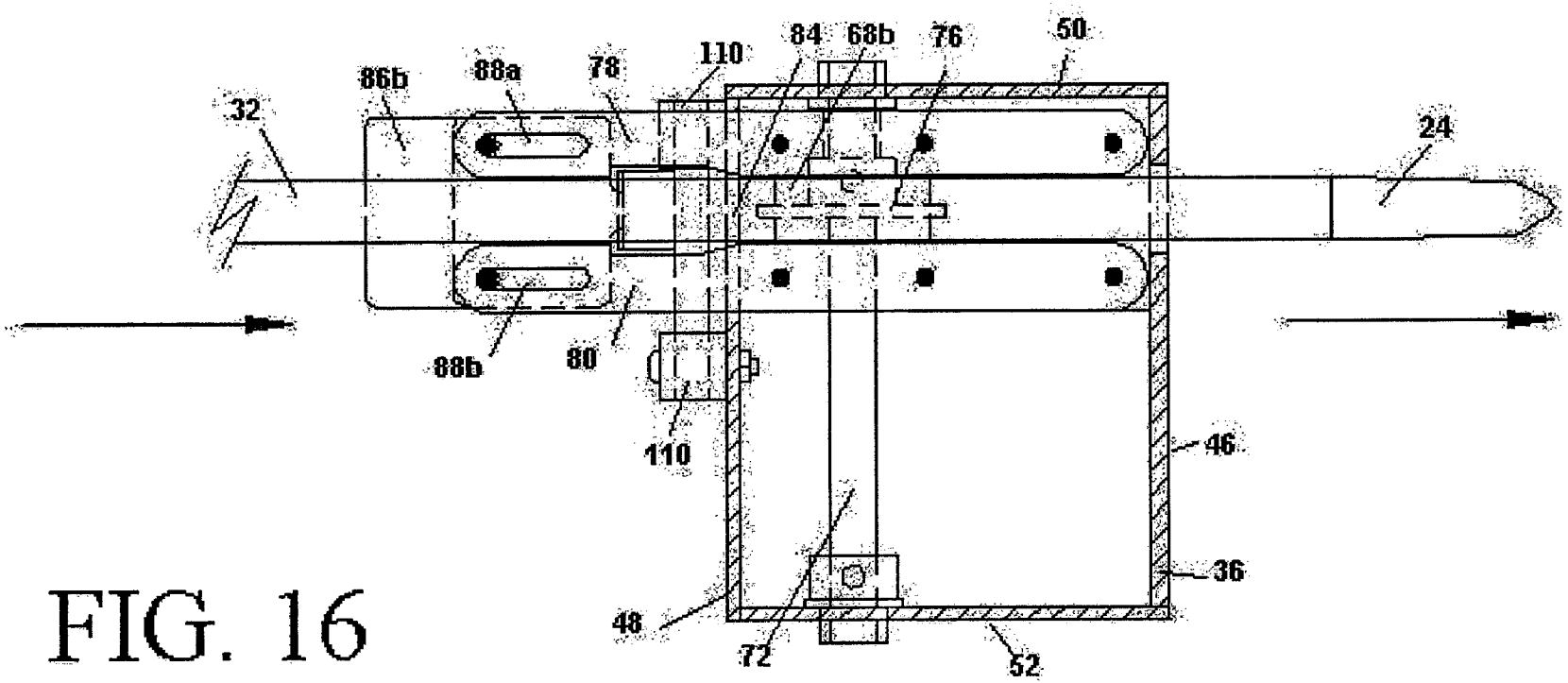
FIG. 16 is a right side partial cross sectional view of the embodiment of a tie-off assembly according to the present invention shown in FIG. 12, shown with a tie wrap being drawn into the housing, in the ready or first position prior to the free end of the tie wrap being cut.

As shown in FIGS. 1-11, the tie-off assembly 30 of the present invention includes a housing 36 that houses certain components of the tie-off assembly 30, and has a top 50, a bottom 52, a motor end 46, a cutting end 48, a first or right side 28, a second or left side 31, and a motor 38. The housing 36 may have at least one housing cover 37, enclosing the contents of the housing 36 and allowing access such as for maintenance, as shown in FIG. 15. Several covers, such as a top and bottom cover, or a left side and right side cover, may be used. However, in most of the Figures, the housing cover 37 has been removed to allow viewing of the contents of the housing 36.

In one embodiment of the present invention, the motor 38 is a pneumatic motor, such as a 500 rpm pneumatic motor. However, it is appreciated that the motor 38 may be electrically driven, mechanically driven, or any other type of motor without departing from the present invention. The motor 38 attaches to the housing 36 via motor clamp 40, or other attachment means. The motor 38 is preferably attached adjacent the bottom 52 of the housing, as shown in FIGS. 1, 2, 8, 12-14. The motor 38 has a drive end 42 with a drive assembly 49 that extends into the housing 36 through drive assembly opening 44. The drive assembly 49 includes a drive shaft 54 that is rotated by the motor 38, and a drive gear 56 at the end of the drive shaft 54. In the illustrated example, the drive gear 56 is a bevel gear. However, it is appreciated that any acceptable gear may be used, such as a worm gear, helical gear, rack and pinion arrangement, spur gear, or other gears as are known in the art.

Figure 2:
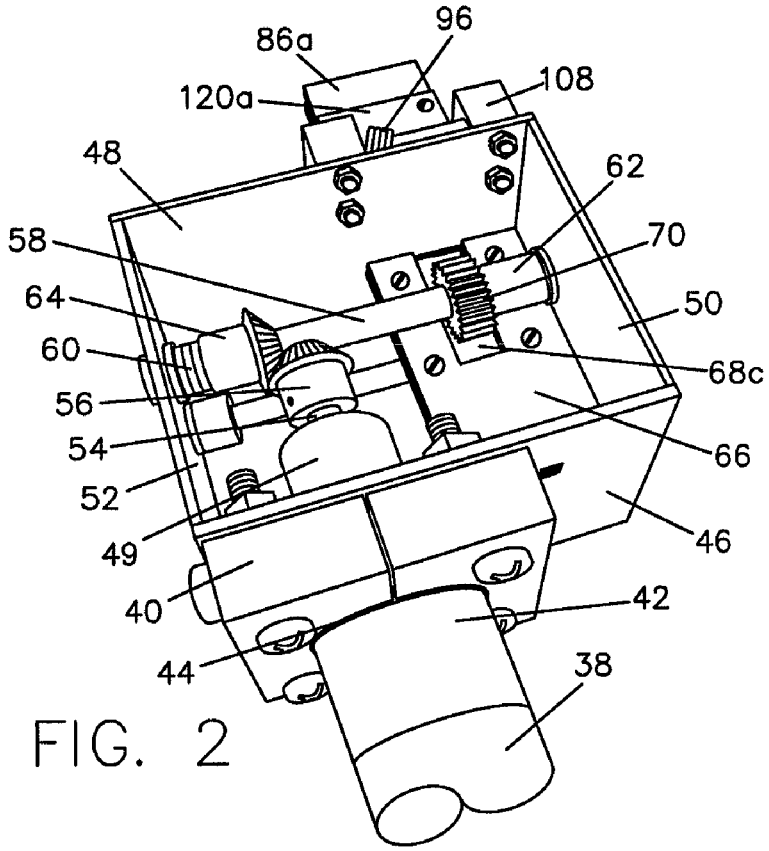
FIG. 2 is a perspective view from the motor end of the tie-off assembly according to the present invention shown in FIG. 1.
Figure 7:
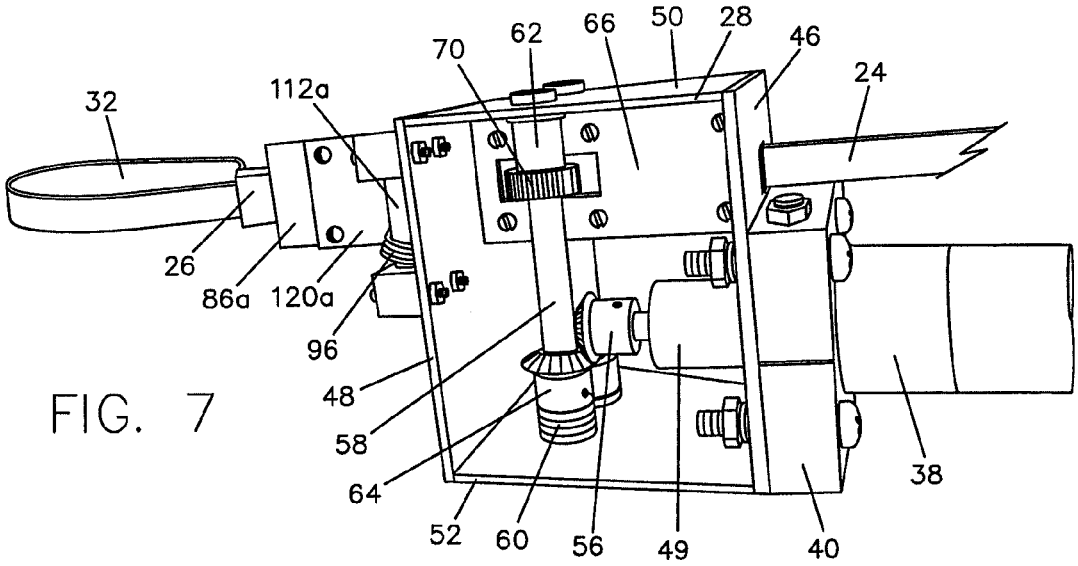
FIG. 7 is a perspective view of the right side of the tie-off assembly according to the present invention shown in FIG. 1, with a tie wrap being drawn into the housing of the tie-off assembly.

A drive axle 58 is provided within the housing 36, having a first end 60 adjacent the bottom 52 of the housing 36 and a second end 62 adjacent the top 50 of the housing 36, mounted vertically within the housing 36, as shown in FIGS. 1, 2 and 7. A gear 64 is mounted on the drive axle 58 adjacent the first end 60, and positioned to engage the drive gear 56. Thus, when the motor 38 turns the drive shaft 54 and drive gear 56, the drive gear 56 will turn the gear 64, thus rotating drive axle 58. As shown, the drive shaft 54 will turn in a clockwise direction about its central axis, as indicated by the arrows, and this will turn drive axle 58 in a counter-clockwise direction about its central axis, as indicated by the arrows. It is also contemplated that the motor 38 can be used to directly drive the drive axle 58, eliminating the need for the drive assembly 49.

A first upstanding housing wall 66 and a second upstanding housing wall 67 are provided within the housing 36, extending from the upper portion of the motor end 46 of the housing 36 to an upper portion of the cutting end 48 of the housing 36. The housing walls 66, 67 are separated by a receiving space 69, adapted to receive the free end 24 of a tie wrap, as will be discussed in further detail below. Each housing wall 66, 67 has an opening **68*a* & 68*b* therethrough. As shown in FIGS. 1, 2, 7, 12-14, the drive axle 58 is positioned adjacent first housing wall 66, and aligned with opening 68*a*. A toothed drive wheel 70 is provided on the drive axle 58 adjacent the second end 62 of the drive axle 58, and adapted to turn when the drive axle 58 is turned. The opening 68*a* is sized to receive the toothed drive wheel 70**.

Figure 5:
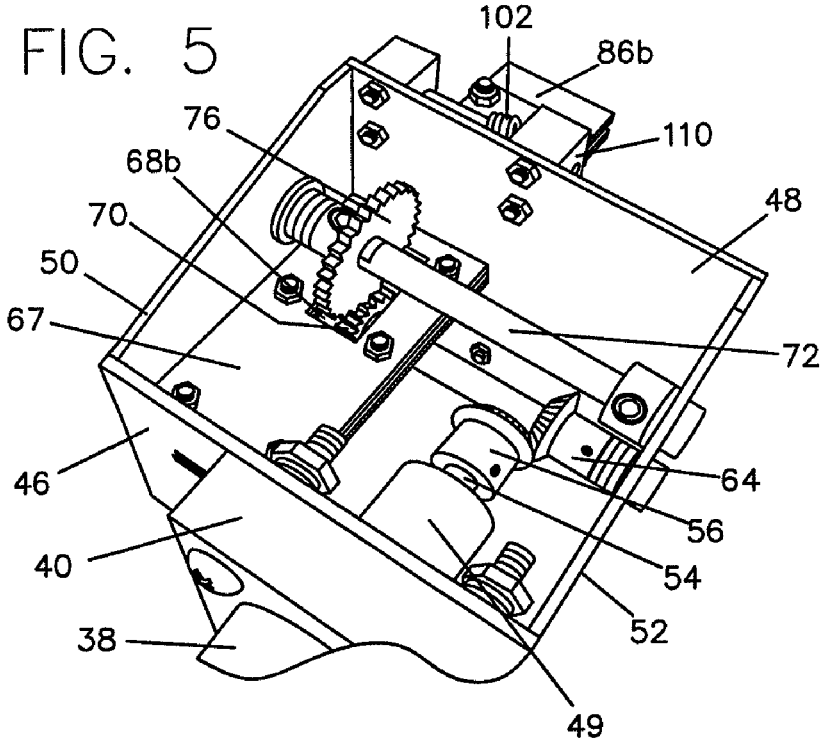
FIG. 5 is a left side perspective view of the tie-off assembly according to the present invention shown in FIG. 1, with the cover removed from the housing.

As shown in FIG. 5, a second axle 72 is provided within the housing 36, having a first end 74 adjacent the bottom 52 of the housing 36 and a second end 75 adjacent the top 50 of the housing, mounted vertically within the housing 36, as shown in FIGS. 5, 11-13, and is positioned generally parallel to the drive axle 58. The second axle 72 is positioned opposite drive axle 58, and adjacent the second housing wall 67. A pinch wheel 76 is mounted on the second axle 72 adjacent the top 50 of the housing 36, and aligned with the opening 68*b*. The pinch wheel 76 is preferably a toothed wheel.

Figure 3:
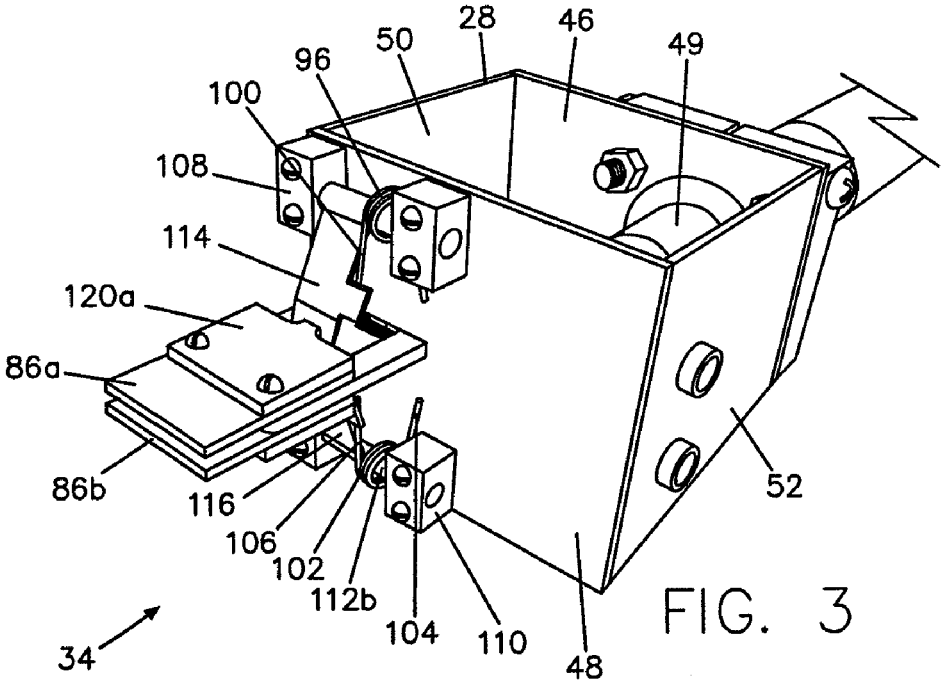
FIG. 3 is a close up perspective view from the cutting end of the tie-off assembly according to the present invention, shown in FIG. 1.
Figure 4:
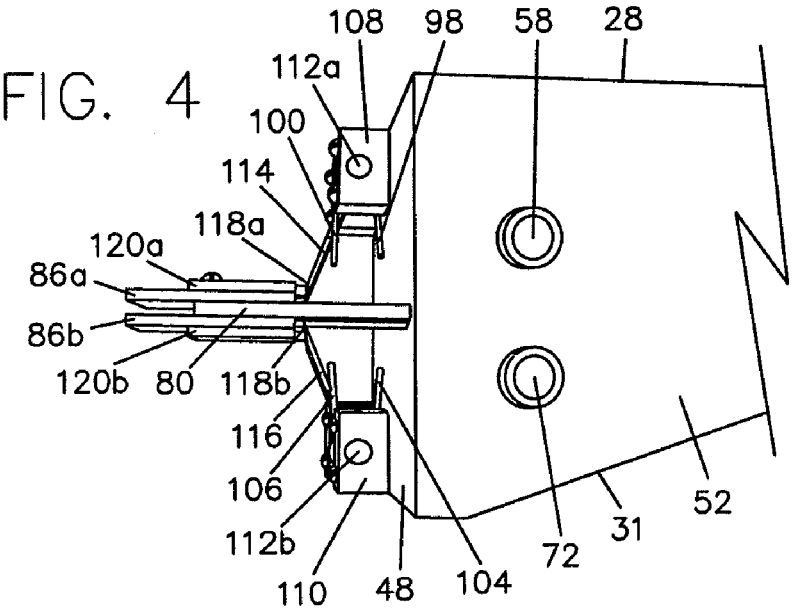
FIG. 4 is a bottom side view of the tie-off assembly according to the present invention shown in FIG. 1.

Referring to FIGS. 1 & 3, a cutting assembly 34 is provided adjacent the cutting end 48 of the housing 36. The cutting assembly 34 includes an upper rail 78 and a lower rail 80 extending from the cutting end 48 of the housing 36, on opposite sides of cutting slot 84 formed in cutting end 48. The cutting slot 84 is formed as an opening in the cutting end 48, and is aligned with the space 69 between the walls 66 & 67.

Figure 12:
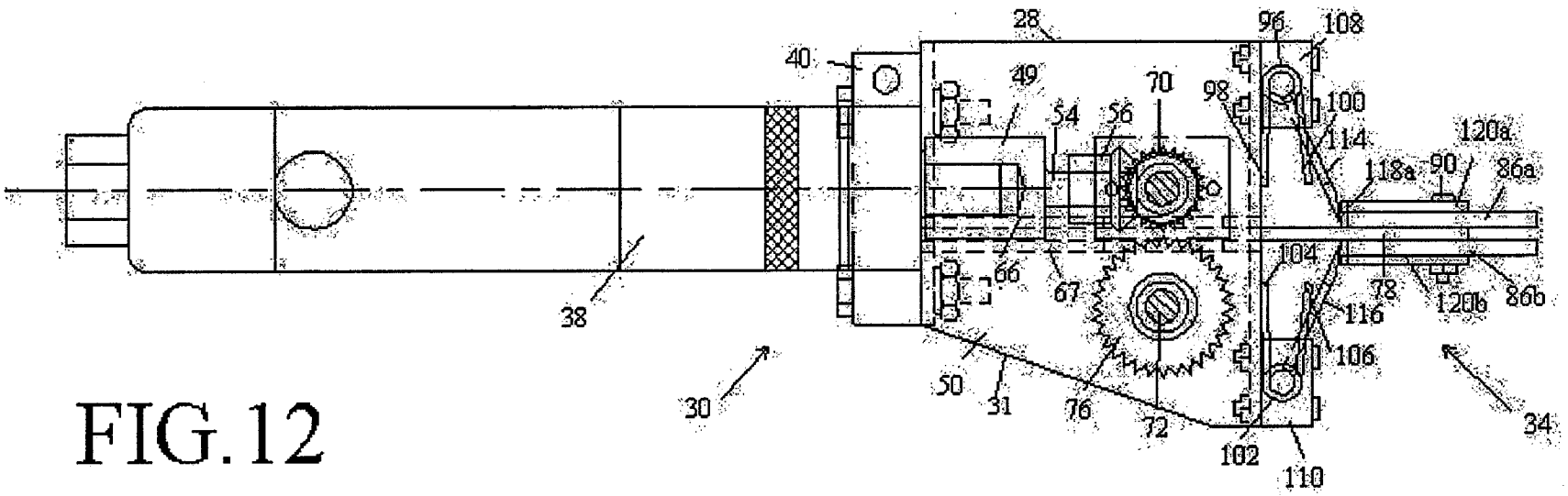
FIG. 12 is a top plan view with partial transparency of an embodiment of a tie-off assembly according to the present invention.
Figure 13:
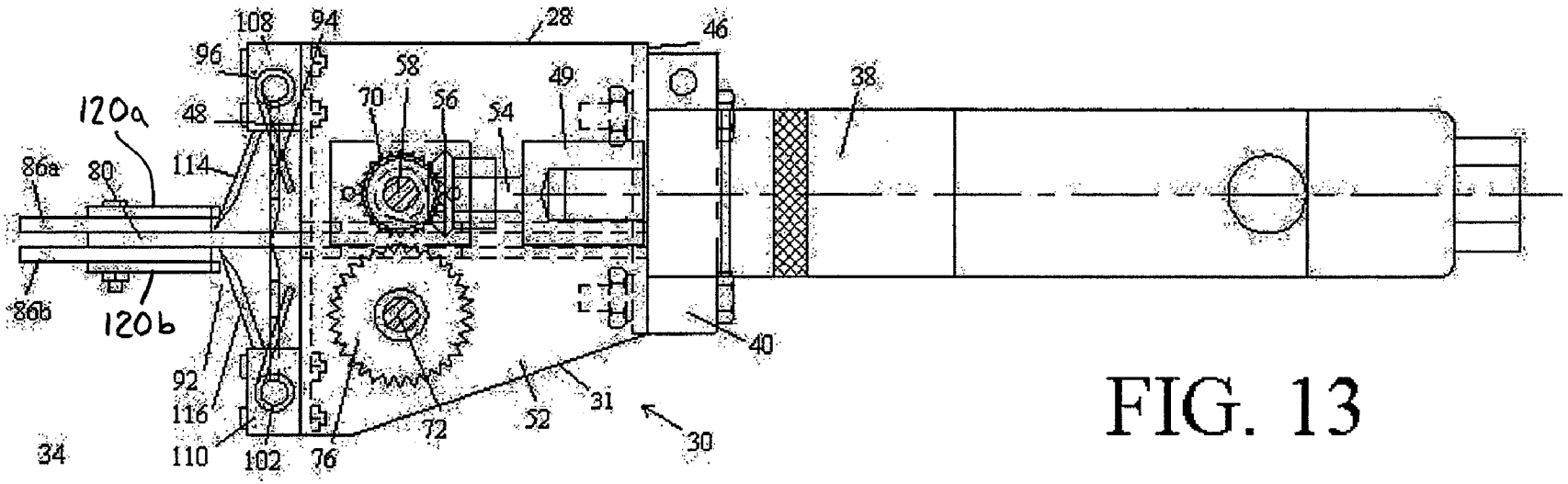
FIG. 13 is a bottom plan view with partial transparency of the embodiment of the tie-off assembly according to the present invention shown in FIG. 12.
Figure 14:
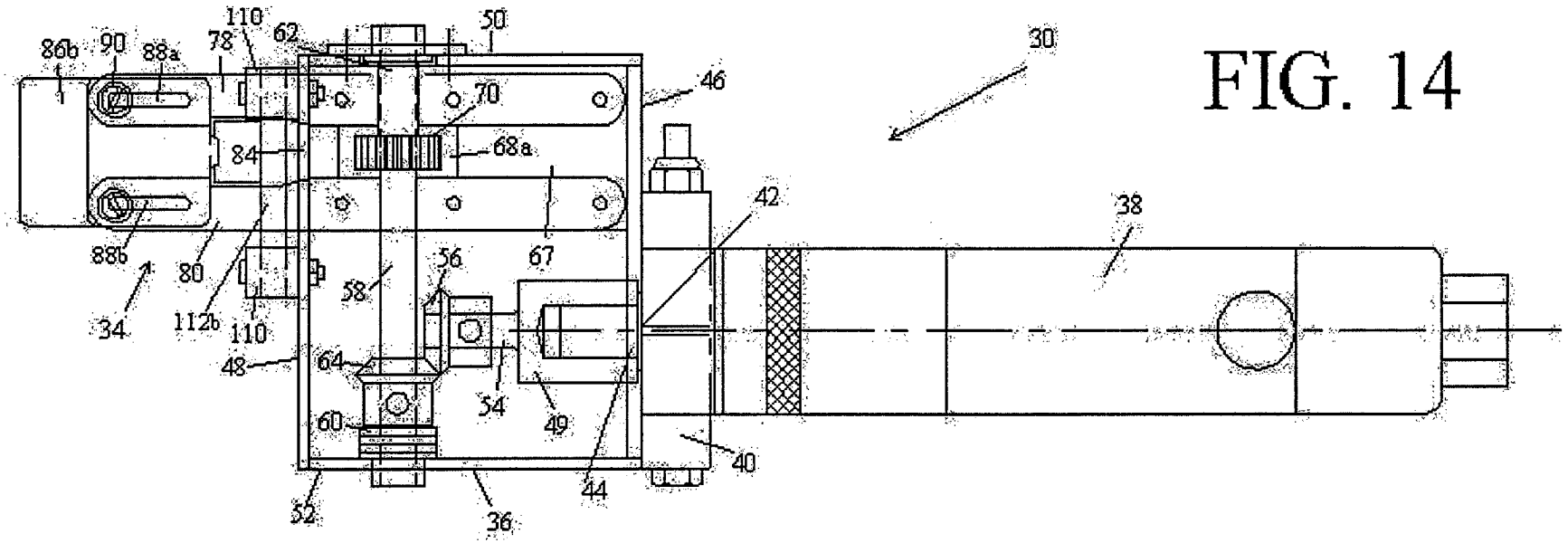
FIG. 14 is a cross sectional view from the right side of the tie-off assembly according to the present invention shown in FIG. 12, with the slide wall in a first or ready position.
Figure 17:
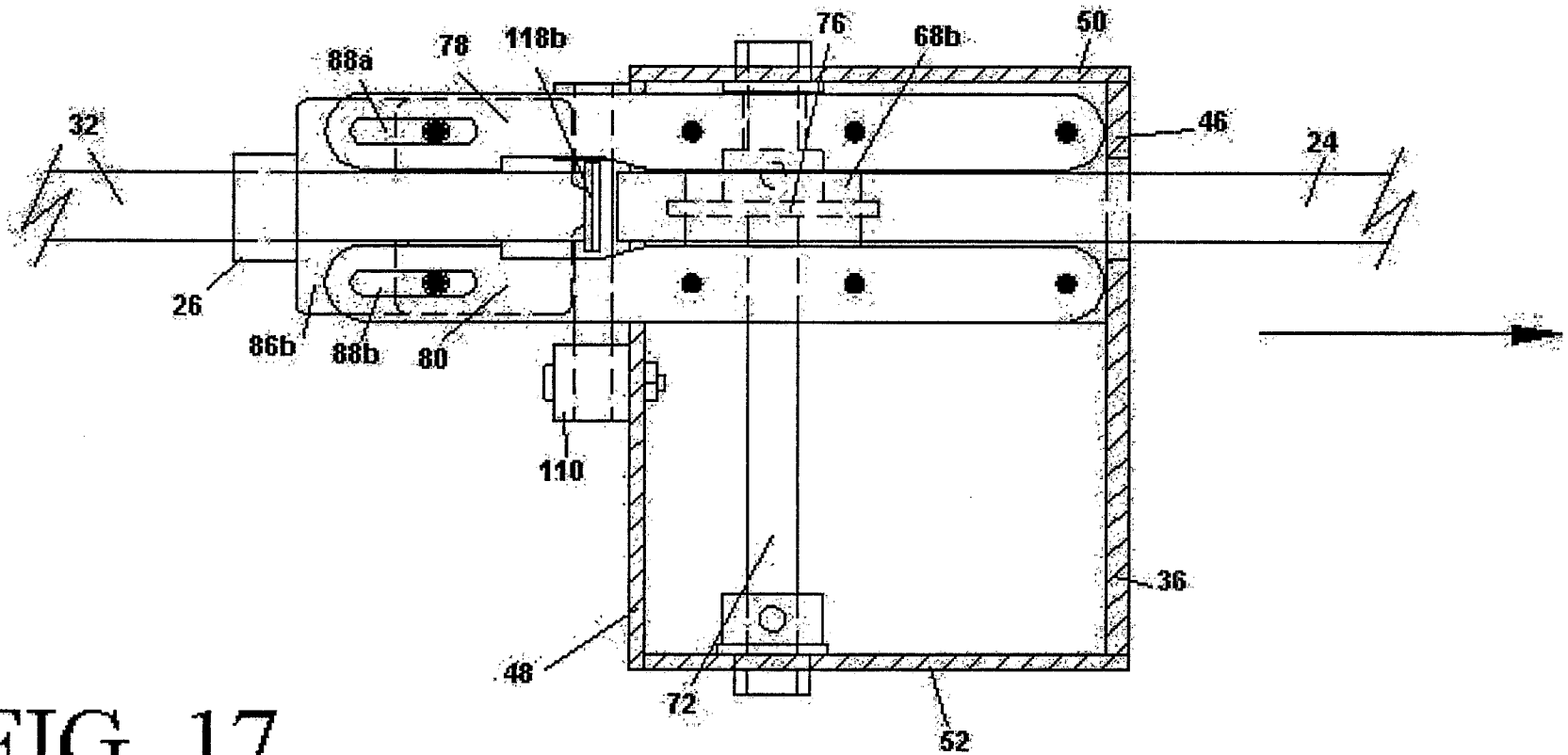
FIG. 17 is a right side partial cross sectional view of the embodiment of a tie-off assembly according to the present invention shown in FIG. 12, shown with a tie wrap being drawn into the housing, in the second or cutting position, with the free end of the tie wrap being cut.
Figure 18:
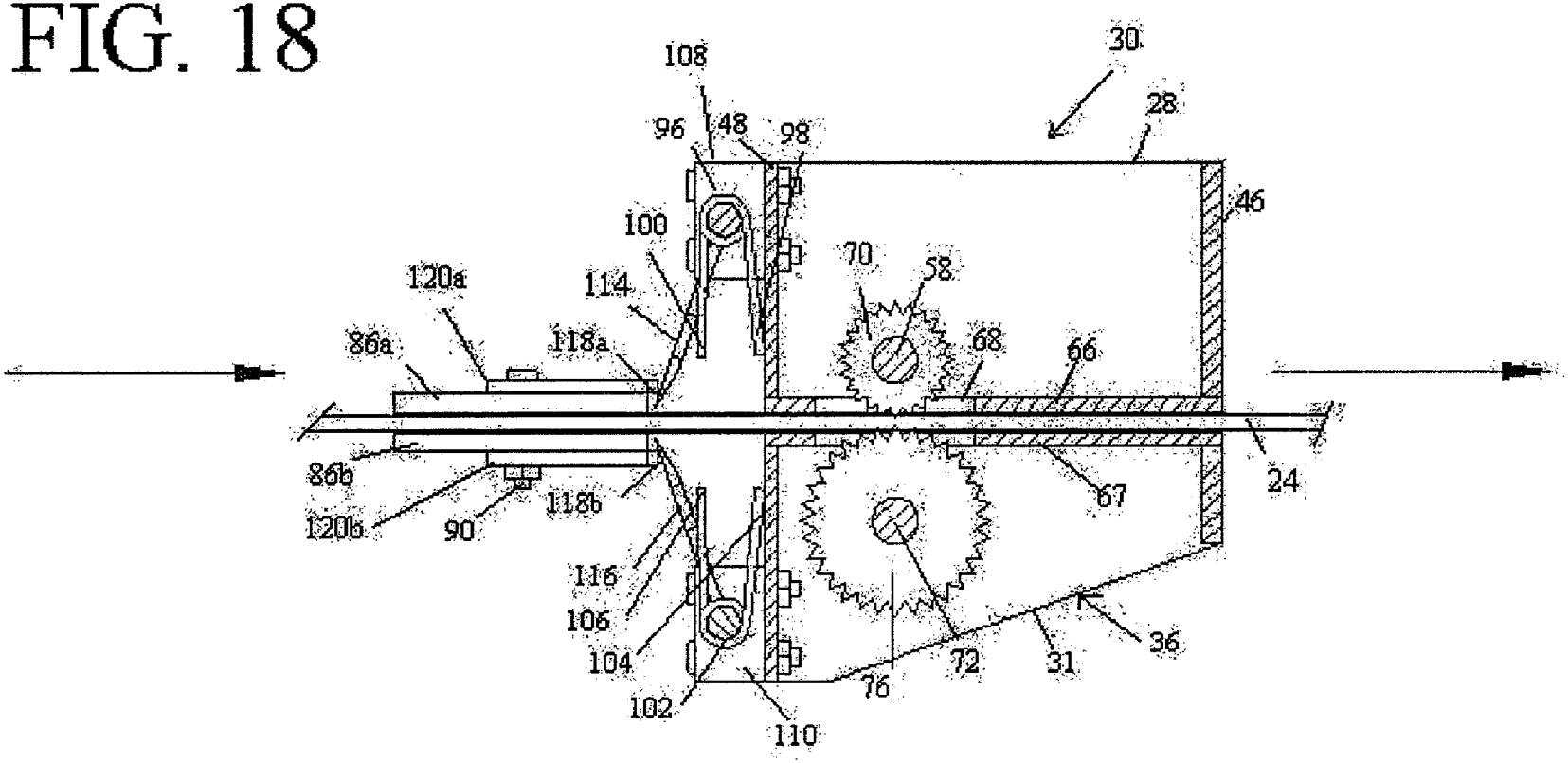
FIG. 18 is a cross sectional view of the embodiment of a tie-off assembly according to the present invention shown in FIG. 12, shown with a tie wrap being drawn into the housing, in the ready or first position prior to the free end of the tie wrap being cut.
Figure 19:
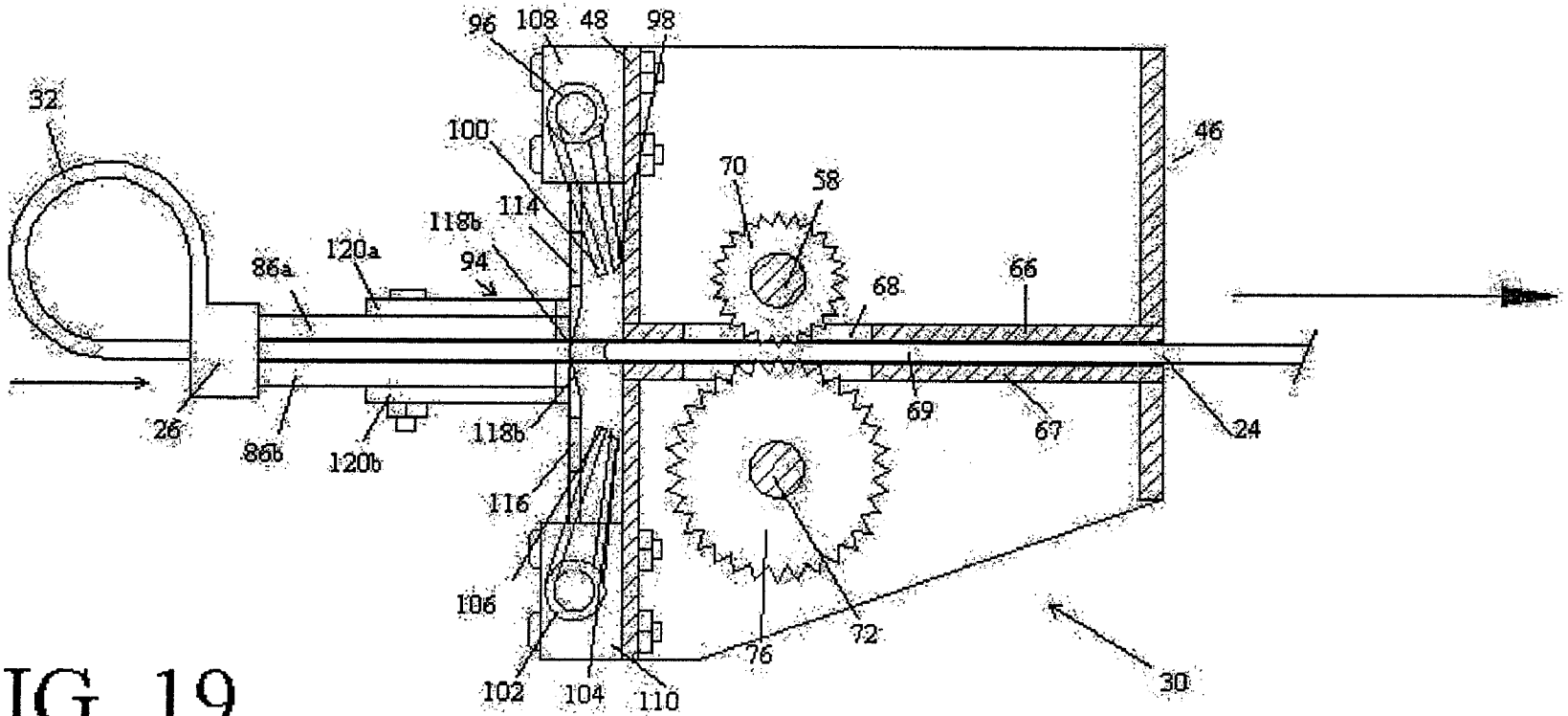
FIG. 19 is a cross sectional view of the embodiment of a tie-off assembly according to the present invention shown in FIG. 12, shown with a tie wrap being into the housing, in the second or cutting position with the tie wrap being cut.

Two slide walls 86*a* & 86*b* are provided on opposite sides of the upper rail 78 and the lower rail 80. Each slide wall 86*a* & 86*b* has at least one bolt receiving opening therethrough. The bolt receiving openings are aligned with the slots 88*a* & 88*b* of the upper rail 78 and the lower rail 80. At least one bolt 90 is provided for securing each slide wall 86*a* & 86*b* to opposite sides of the upper rail 78 and the lower rail 80, with the bolts 90 passing through the bolt receiving openings and slots 88*a* & 88*b*. This arrangement allows the slide walls 86*a* & 86*b* to move freely in relation to the upper rail 78 and the lower rail 80, with each being adapted to move from a first or forward position 92, as shown in FIGS. 7-12, 16 & 18, to a second or cutting position 94, as shown in FIGS. 17 & 19, and as will be explained in greater detail below. Outer wall 120*a* & 120*b* are provided, with the outer wall 120*a* being adjacent to and connected to slide wall 86*a*, and outer wall 120*b* adjacent to and connected to slide wall 86*b*. The outer walls 120*a* & 120*b* are adapted to move with the slide walls 86*a* & 86*b*. In addition, in a preferred embodiment, the outer walls 120*a* & 120*b* extend more rearward than slide walls 86*a* & 86*b*, and are closer in proximity to the cutting end 48 than slide walls 86*a* & 86*b*, as shown in FIGS. 12 & 13.

Figure 6:
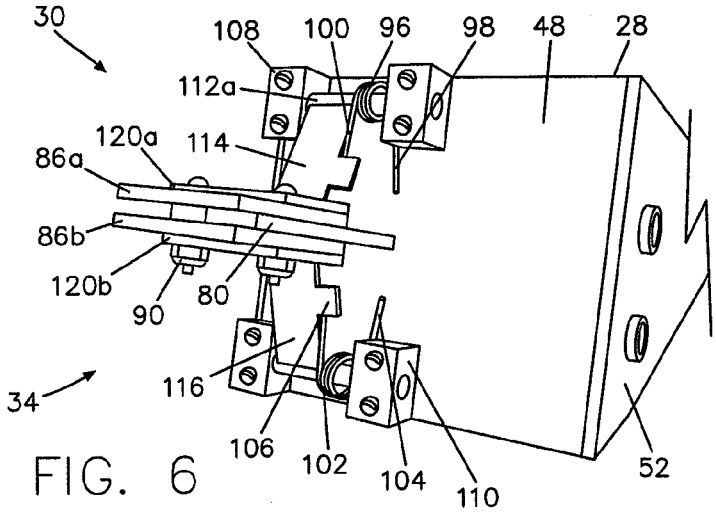
FIG. 6 is a perspective view from the cutting end of the tie-off assembly according to the present invention shown in FIG. 1.

As shown in FIGS. 1 & 6, a first blade mounting assembly 108 is provided extending from the cutting end 48 of the housing 36 adjacent slide wall 86*a*, and a second blade mounting assembly 110 is provided extending from the cutting end 48 of the housing 36 adjacent slide wall 86*b*. Each blade mounting assembly 108, 110, has a mounting post 112*a* & 112*b*. A first blade 114 is rotatably mounted on mounting post 112*a*, and a second blade 116 is rotatably mounted on mounting post 112*b*. Each blade 114, 116 has a sharp cutting end 118*a*, 118*b*. The cutting end 118*a* of the first blade 114 is positioned to be contacted outer wall 120*a*, while the cutting end 118*b* of the second blade 116 is positioned to be contacted by outer wall 120*b*.

A first torsion spring 96 having a first end 98 and a second end 100 is provided adjacent slide wall 86*a*, and a second torsion spring 102 having a first end 104 and a second end 106 is provided adjacent slide wall 86*b*. The first torsion spring 96 is positioned about mounting post 112*a*, with the first end 98 against the cutting end 48, and the second end contacting a portion of the first blade 114, and biasing the first blade 114 to a first or ready position, as shown in FIGS. 4, 6, 12, 18-19. The second torsion spring 102 is positioned about mounting post 112*b*, with the first end 104 against the cutting end 48, and the second end 106 contacting a portion of the second blade 116, biasing the second blade 116 to a first or ready position. The size of the torsion springs 96, 102 can be adjusted in order to provide different cinching forces on the tie wrap being closed prior to the blades 114, 116 engaging and cutting off the end of the tie wrap, ending the closing operation.

While a preferred tie wrap end cutting arrangement has been shown, those skilled in the art will recognize that other types of cutting arrangements can be utilized that can be actuated in different manners, if desired, and the invention is not limited to the specific cutting arrangement disclosed.

Figure 22:
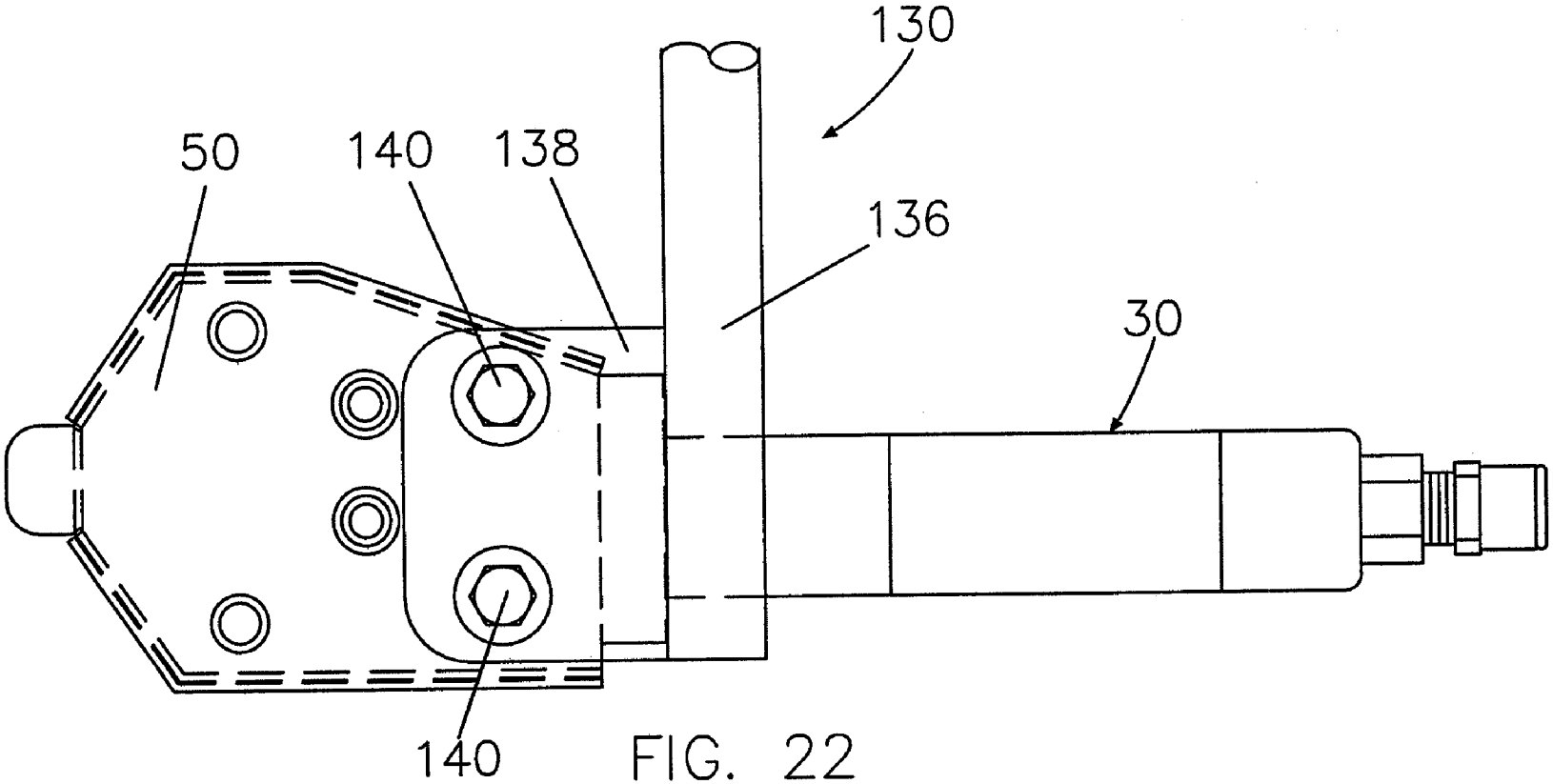
FIG. 22 is a top view showing the connection of the tie-off assembly to an end of the pivoting support arm.
Figure 23:
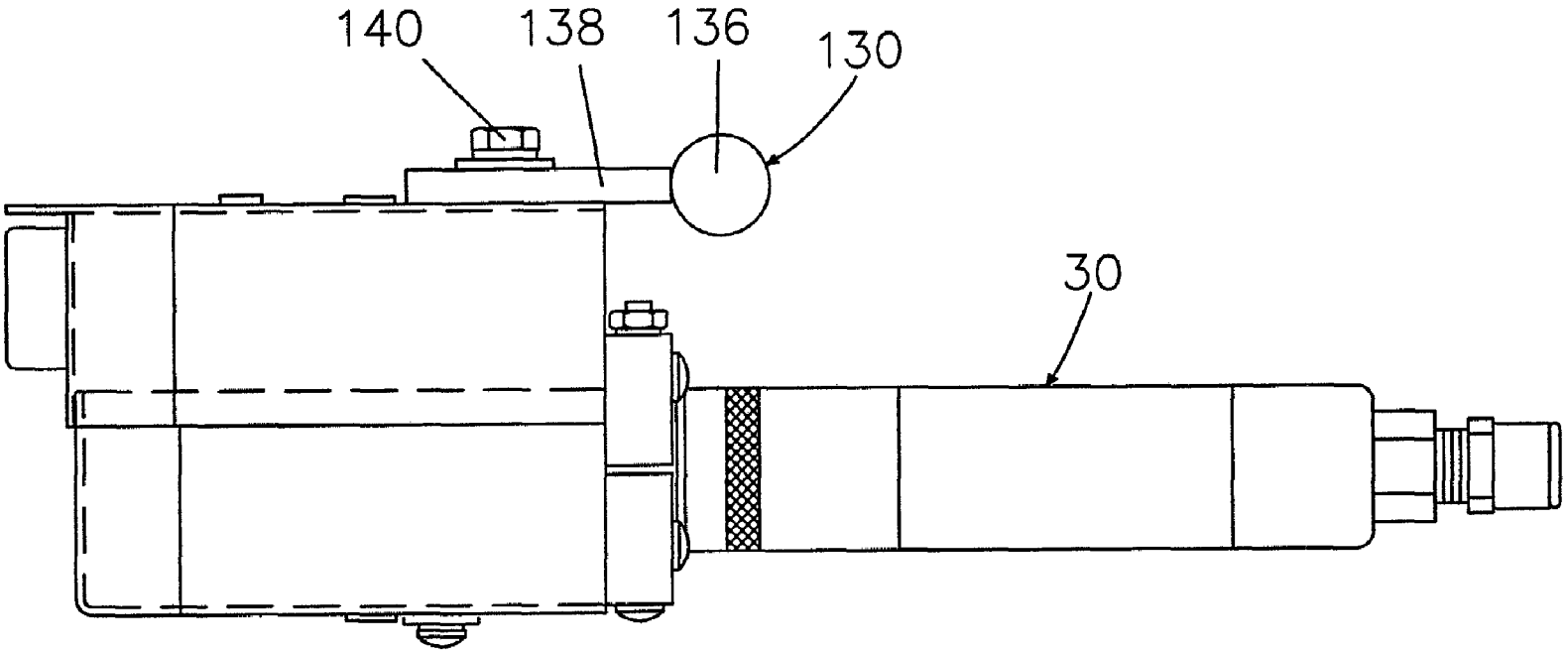
FIG. 23 is an enlarged front view showing the tie-off assembly mounted on the pivoting support arm.
Figure 24:
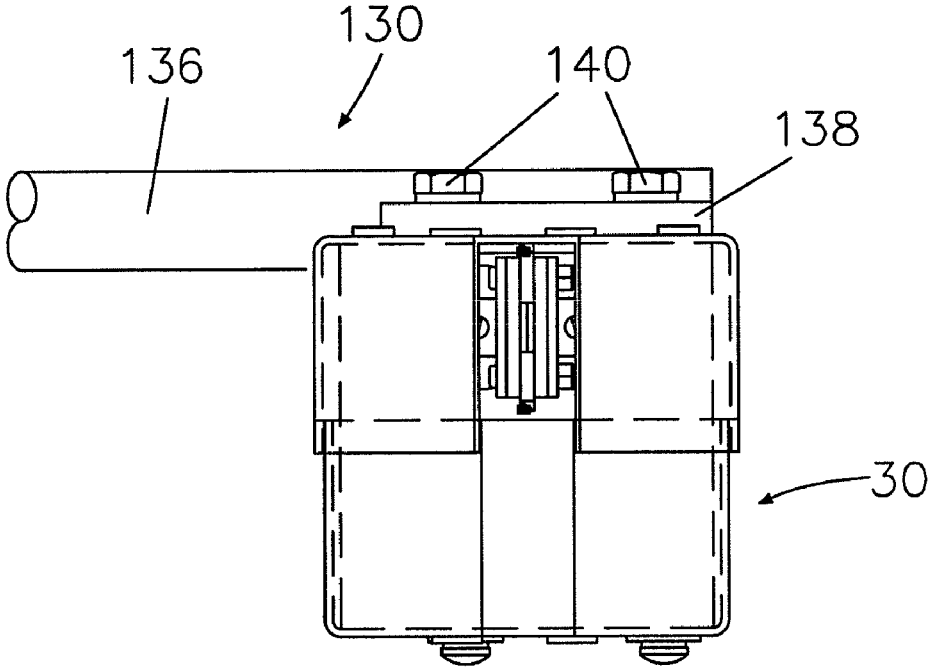
FIG. 24 is a side elevational view of the cutting end of the tie-off assembly mounted on the pivoting support arm.

As shown in FIGS. 20-24, the tie-off assembly 30 is preferably mounted for movement to the frame of the bulk bag filler 10. In a preferred embodiment, the tie-off assembly 30 is mounted to a pivoting arm 130 that is pivotally connected to the bag filling head mounted on the frame of the bulk bag filler 10 about a pivot axis 132, shown in FIG. 21. This allows the tie-off assembly 30 to move along the path 134, shown in FIG. 21, toward a center of the bag neck 22 as it cinches the bag neck 22 closed using the tie wrap 32. As shown in Figures 22-24, the pivoting arm 130 is preferably a tube or bar 136 and includes a mounting bracket 138 on the end thereof. The mounting bracket 138 is preferably connected to the top 50 of the tie-off assembly 30, using fasteners 140, such as bolts.

Alternatively, the tie-off assembly 30 of the present invention can be mounted on the bulk bag filler 10 using a frame and/or track, and thereby move using the tie wrap as a traction medium. The tie-off assembly 30 can also be adapted to move in relation to the bulk bag 18 such as on a slide rail or linear slide arrangement, or the tie-off assembly 30 could be mounted for both linear and rotational movement (for example, up to about 180 degrees) so that the tie-off assembly 30 twists the bag neck 22 as it tightens.

In operation, a bulk bag 18 is suspended from the support frame 12 of the bulk bag filler 10, and the fill tube 20 is inserted into the filling spout or neck 22 of the bulk bag 18. The end of the tie wrap 32, located around the bag neck 22 with a free end 24 of the tie wrap 32 fed through the knuckle (tie wrap locking portion) 26, is inserted through the space between the upper rail 78 and a lower rail 80 and into the slot 84. The free end 24 is positioned extending through the cutting slot 84 and extends into space 69, between the toothed drive wheel 70 and pinch wheel 76. and engaged between the drive wheel 70 and the pinch wheel 76. The inflatable seal 21 inflates to seal the neck 22 about the fill tube 20. After the bulk bag 18 is filled, the inflatable seal 21 deflates, and the fill tube 20 is withdrawn from the bag neck 22.

The tie wrap 32 is preferably pre-positioned on the bag neck 22 during suspension of the empty bulk bag 18. Alternately, the tie wrap 32 can be positioned about the bag neck 22 after the bulk bag 18 is filled.

Operating the motor 38 rotates drive shaft 54, thereby rotating the drive gear 56, which in turn rotates the gear 64, which in turn rotates drive axle 58, thereby turning toothed drive wheel 70. The free end 24 of the tie wrap 32 is frictionally gripped through the openings 68*a* & 68*b* between toothed drive wheel 70 and pinch wheel 76, drawing the free end 24 into the housing 36, within space 69. This movement will tighten the tie wrap 32 about the neck 22 of the bulk bag 18, with the tie-off assembly 30 moving inwardly as it pulls the tie wrap 32 through pivoting movement of the support arm 130 about the axis 132.

When the tie wrap 32 is tightened to a selected degree around the bag neck 22, the knuckle 26 of the tie wrap 32 will press against the slide walls 86*a* & 86*b*, as shown in FIGS. 7, 10, 17, 19. As the toothed drive wheel 70 pulls the free end 24 of the tie wrap 32 further into the housing 36, the knuckle 26 will further press against slide walls 86*a* & 86*b*, which are adapted to freely move toward the cutting end 48. As the slide walls 86*a* & 86*b* move to a cutting position adjacent the cutting end 48, the slide walls 86*a* & 86*b* contact the blades 114, 116, rotating the blades 114, 116 against the force of the springs 96, 102 toward the free end 24 of the tie wrap 32. Continued movement of the slide walls 86*a* & 86*b* toward the cutting end 48 forces the blades 114, 116 to move to the second or cutting position, as shown in FIGS. 13, 17 & 19, overcoming the spring force of the springs 96, 102, thereby cutting a portion of the tie wrap 32 with the cutting ends 118*a* & 118*b* of the blades 114, 116.

Once the tie wrap 32 is cut, the springs 96, 102 bias the blades 114, 116 back to a first or ready position. The tie-off assembly 30 is now ready to close off another bulk bag 18 after it is loaded onto and filled by the bulk bag filler 10.

It will be appreciated by those skilled in the art that changes can be made to the embodiment of the invention described above without departing from the broad inventive concept thereof. It is also understood that various portions of the invention can be used alone or in combination and that not all of the components are required for any particular application. It is therefore understood that this invention is not limited to the particular embodiment disclosed, but is intended to cover modifications within the spirit and scope of the present invention.

What is claimed is:

1. A method of tying off a neck of a bulk bag, comprising:

suspending a bulk bag from a bulk bag filler;

inserting a fill tube into the of the bulk bag;

inserting an end of a tie wrap located around the open neck into a slot leading to a longitudinally extending tie wrap end receiving path in a bag tie-off assembly so that the tie wrap end is engaged by a toothed drive wheel thereof;

operating a motor of the tie-off assembly to turn the toothed drive wheel, tightening the tie wrap about the neck of the bulk bag to close the neck of the bulk bag; and cutting off the end of the tie wrap after it is tightened using at least one longitudinally movable wall mounted adjacent to the slot that moves from a first, rest position to a second, engaged position, the at least one movable wall contacting and moving a pivoting blade to a cutting position as the movable wall being slidably mounted on the housing adjacent the slot for longitudinal movement due to contact with a locking portion of the tie wrap as the tie wrap is tightened in a direction of the longitudinally extending tie wrap end receiving path.

2. The method of claim 1, further comprising:

cutting off the end of the tie wrap once the tie wrap is tightened to a selected degree around the bag neck.

3. The method of claim 1, further comprising:

moving the tie-off assembly toward the bag neck as the tie wrap is tightened.

4. A tie-off assembly for closing a neck of a bulk bag by tightening a tie wrap around the neck, comprising:

a motor;

a housing having a cutting end with a slot therethrough leading to a longitudinally extending tie wrap end receiving path;

a toothed drive wheel mounted along the path to engage the tie wrap end and being connected to the motor;

at least one pivoting blade mounted adjacent the cutting end, the at least one blade moveable from a first position, pivoted away from the slot, to a second, cutting position pivoted adjacent the slot at least one longitudinally movable wall mounted adjacent the cutting end that is movable from a first, rest position to a second, engaged position adjacent the cutting end, the at least one movable wall adapted to contact and move the pivoting blade to the cutting position as the movable wall moves longitudinally toward the second, engaged position; and the movable wall is slidably mounted for longitudinal movement due to contact with a locking portion of the tie wrap as the tie wrap is tightened in a direction of the longitudinally extending tie wrap end receiving path on the housing adjacent the slot.

5. The tie-off assembly of claim 1, further comprising:

an upper rail extending from the cutting end adjacent the slot having a first side and a second side, the upper rail having a guide slot therethrough;

a lower rail extending from the cutting end on an opposite side of the slot having a first side and a second side, the lower rail having a guide slot therethrough;

wherein the at least one movable wall is connected to the first side of the upper rail by a first bolt extending through an opening in the at least one first wall and the guide slot in the upper rail, and the at least one movable wall is connected to the lower rail by a second bolt extending through an opening in the at least one movable wall and the guide slot in the slot in the lower rail.

6. The tie-off assembly of claim 5, further comprising a second movable wall mounted on the second side of the upper rail and lower rail, wherein the second movable wall is connected to the second side of the upper rail by the first bolt extending through a first opening in the second wall, and the second wall is connected to the second side of the lower rail by the second bolt extending through a second opening in the second wall.

7. The tie-off assembly of claim 1, further comprising a spring biasing the blade to the first position.

8. The tie-off assembly of claim 1, further comprising a rotatable pinch wheel positioned adjacent the toothed drive wheel.

9. A bulk bag filler with a bag tie-off assembly for tying off filled bulk bags, comprising:

a frame with a bag fill head supported thereon;

a bag tie-off assembly supported by the frame or the bag fill head, located in proximity to a connection between a neck of the bulk bag and a fill tube, the bag tie-off assembly including a housing with a slot therein, a toothed drive wheel in the housing that is driven by a motor, a cutting blade located in proximity to the slot and a cutting blade actuator, the slot is adapted to receive an end of a tie wrap positioned around the bulk bag neck so that upon the bag being filled the toothed drive wheel engages the end of the tie wrap to tighten the tie wrap to close the bag neck and the blade is actuatable after the tie wrap is tightened to close the bag neck, to cut off the end of the tie wrap, and the cutting blade is pivotably mounted and at least one movable wall is mounted adjacent to the cutting blade and is movable in a longitudinal direction of a tie wrap end receiving path through the bag tie-off assembly from a first, rest position to a second, engaged position, the at least one movable wall is movable via contact with a locking portion of the tie wrap and is adapted to contact and move the pivotably mounted blade to a cutting position as the tie wrap is tightened a predetermined amount.

10. The bulk bag filler of claim 9, further comprising:

an upper rail extending from the housing adjacent to the slot having a first side and a second side, the upper rail having an upper guide slot therethrough;

a lower rail extending from the housing on an opposite side of the slot having a first side and a second side, the lower rail having a lower guide slot therethrough;

wherein the at least one movable wall is connected to the first side of the upper rail by a first fastener extending through an opening in the at least one first wall and the guide slot in the upper rail, and the at least one movable wall is connected to the lower rail by a second fastener extending through an opening in the at least one movable wall and the guide slot in the slot in the lower rail.

11. The bulk bag filler of claim 10, further comprising a second movable wall mounted on the second side of the upper rail and lower rail, wherein the second movable wall is connected to the second side of the upper rail by the first bolt extending through a first opening in the second wall, and the second wall is connected to the second side of the lower rail by the second bolt extending through a second opening in the second wall.

12. The bulk bag filler of claim 10, wherein the movable wall is slidably mounted on the housing adjacent the slot.

13. The bulk bag filler of claim 9, further comprising a rotatable pinch wheel positioned adjacent the toothed drive wheel.

14. The bulk bag filler of claim 9, further comprising a spring that biases the blade to a first, non-cutting position.

* * * * *

UNITED STATES PATENT AND TRADEMARK OFFICE

CERTIFICATE OF CORRECTION

PATENT NO. : 7,617,655 B2
APPLICATION NO. : 11/428709
DATED : November 17, 2009
INVENTOR(S) : Gill et al.

It is certified that error appears in the above-identified patent and that said Letters Patent is hereby corrected as shown below:

At column 1, line 33, after the word "operator", delete "injury" and insert therefor --injury.--.

In claim 1, at column 7, line 20, after the word "into", delete "the of" and insert therefor --the neck of--.

In claim 4, at column 7, line 55, after the word "the", delete "slot" and insert therefor --slot;--.

In claim 5, at column 8, line 1, after the word "assembly", delete "claim 1," and insert therefor --claim 4,--.

In claim 7, at column 8, line 23, after the word "of", delete "claim 1," and insert therefor --claim 4,--.

In claim 8, at column 8, line 25, after the word "of", delete "claim 1," and insert therefor --claim 4,--.

Signed and Sealed this

Twenty-third Day of March, 2010

David J. Kappos

David J. Kappos
*Director of the United States Patent and Trademark Office*